United States Patent [19]

Greppmair

[11] Patent Number: 4,673,043

[45] Date of Patent: Jun. 16, 1987

[54] HAMMER HAVING A PROTECTIVE COVER

[75] Inventor: Martin Greppmair, Munich, Fed. Rep. of Germany

[73] Assignee: Wacker Werke GmbH & Co. KG, Munich, Fed. Rep. of Germany

[21] Appl. No.: 812,402

[22] Filed: Dec. 23, 1985

[30] Foreign Application Priority Data

Dec. 24, 1984 [DE] Fed. Rep. of Germany ..... 3447401

[51] Int. Cl.[4] ..... E21B 3/00

[52] U.S. Cl. ..... 173/162 H; 173/162 R; 173/139

[58] Field of Search ..... 173/162 R, 162 H, 133, 173/118, 17, 139

[56] References Cited

U.S. PATENT DOCUMENTS

| | | | |
|---|---|---|---|
| 3,275,089 | 9/1966 | Kaiser et al. | 173/162 |
| 4,014,392 | 3/1977 | Ross | 173/162 X |
| 4,060,138 | 11/1977 | Cox et al. | 173/162 H X |
| 4,102,410 | 7/1978 | Ross | 173/162 X |

*Primary Examiner*—E. R. Kazenske
*Assistant Examiner*—Willmon Fridie, Jr.
*Attorney, Agent, or Firm*—Becker & Becker, Inc.

[57] ABSTRACT

A motor-driven hammer having an impact mechanism that is driven by the motor via a crank drive. The hammer has a protective cover that is provided with handgrips and is cushioned relative to the housing of the hammer. When viewed in the upright position of operation of the hammer, the cover is spaced from, and covers, the top, both sides, and the front of the motor and crank drive, at least relative to an operator. Two pairs of swing arms extend on both sides between the housing and the cover for positively guiding the cover parallel to the longitudinal axis of the hammer. The swing arms of a given pair of arms are disposed parallel to one another, and are spaced apart one above the other. Each arm has two ends, one of which is pivotably mounted on the cover, and the other of which is pivotably mounted on the housing. This pivotable mounting is effected by pivot mechanisms, at least some of which are embodied in the form of soft torsion springs. The swing arms have a pivot range that is free except for the torsion spring effect. Stops are provided for elastically delimiting the free pivot range of the arms. These stops cooperate in a cushioned manner and are disposed on the housing and on the cover. The stops have a spring force that increases progressively outwardly from the free pivot range of the swing arms.

8 Claims, 7 Drawing Figures

HAMMER HAVING A PROTECTIVE COVER

BACKGROUND OF THE INVENTION

1. Field of the Invention

The present invention relates to a motor-driven hammer having an impact mechanism that is driven by the motor via a crank drive. The hammer has a protective cover that is provided with handgrips and is cushioned relative to the housing of the hammer. When viewed in the upright position of operation of the hammer, the cover covers, and is spaced from, the top, both sides, and the front of the motor and the crank drive, at least relative to an operator. With hammers of this general type, the task of the cover is to protect the operator from heat radiating from the hot motor parts, and from direct contact with these parts. The cover is also intended for muffling radiation of noise from the motor into the environment, and especially to the operator. In addition, the cover protects the operator from current pulses, which with apparatus of this type can be caused, for example, by striking an underground cable with the bit during breaking-up operations, or, with electric hammers, by carelessly damaging the actual electrical lead on the motor, thus conveying dangerous voltage to the motor parts of the hammer. Furthermore, by disposing the handgrips for guiding the hammer on the protective cover, the latter fulfills the additional task of cushioning the grip, and hence of avoiding damaging the health of the operator and of increasing the operating comfort for the latter.

2. Description of the Prior Art

With the heretofore known hammers of the aforementioned general type (German Offenlegungsschrift No. 30 35 351), the protective cover is supported at a number of locations on the hammer housing via simple springs. As a result, under certain operating conditions, the cover can twist or tilt relative to the housing. The cover is then in direct contact with the housing, and to a large extent loses its ability to fulfill the aforementioned tasks. With the heretofore known hammers, the ability of the protective cover to function is also extensively impaired as the operating pressure exerted upon the handgrips by the operator increases. The same is true for pulling upon the handgrips, which is done by the operator when he tries, with the hammer, to again pull out a bit that has become jammed, for example in working in concrete. In these cases, the cause for the reduction of the ability of the cover to function is the spring force of the simple springs between the cover and the housing which spring force increases very sharply and linearly already with comparatively small relative movements between the cover and the housing. These simple springs must be very strong so that contact between the motor housing and the protective cover cannot already occur under normal operating conditions. If the springs are too weak, or even if extreme pressure or pulling is exerted upon the cover via the handgrips, the known dangerous jarring blows can occur even without direct contact between the cover and the housing. These jarring blows are transmitted from the hammer, via the completely compressed springs, to the protective cover as spring block shocks.

An object of the present invention therefore is to provide a hammer of the aforementioned general type that is designed in such a way that the protective cover has no possibility of coming into contact with the hammer housing, that both the left and the right handgrip are always uniformly cushioned independent of the size of the operator, that jarring blows of the cushioned cover with the housing are precluded even under high pressures and pulling forces exerted by the operator upon the handgrips, and that nevertheless the cushioning of the handgrips is very soft in the normal operating range during customary applications, so that the operator can hardly feel any vibration.

This object, and other objects and advantages of the present invention, will appear more clearly from the following specification in conjunction with the schematic drawings, in which.

SUMMARY OF THE INVENTION

The hammer of the present invention is characterized primarily by two pairs of swing arms that extend on both sides between the hammer housing and the protective cover for positively guiding the latter parallel to the longitudinal axis of the hammer. The swing arms of a given pair of arms are disposed parallel to one another, and are spaced apart one above the other. Each arm has two ends, one of which is pivotably mounted on the cover, and the other of which is pivotably mounted on the housing. This pivotable mounting is effected by pivot means, at least some of which are embodied in the form of soft torsion springs. The swing arms have a pivot range that is free except for the torsion spring effect. The inventive hammer is also characterized by stops for elastically delimiting this free pivot range of the swing arms. The stops cooperate in a cushioned manner, and are disposed on the housing and on the cover. The stops have a spring force that increases progressively outwardly from the free pivot range of the swing arms.

The inventively provided and disposed swing arms, which are mounted on the protective cover and on the motor housing, effect a permanent and positive parallel guidance of the cover relative to the housing, and reliably prevent any twisting or tilting of the cover. The cushioning of the swing arms via torsional sleeves enables a very flat and extensively linear spring characteristic in the normal operating range. The delimiting of this normal operating range via elastic stops having a progressively increasing spring characteristic permits high pulling forces and pressure to be exerted upon the handgrips beyond this normal operating range without the danger of jarring blows. In this way, the inventive protective cover provides an optimum operability of hammers that up to now could not be achieved. This applies to hammers driven by a gasoline engine, as well as to hammers driven by an electric motor or other motors.

Specific features of the present invention will be described subsequently.

DESCRIPTION OF PREFERRED EMBODIMENTS

Figure 1:
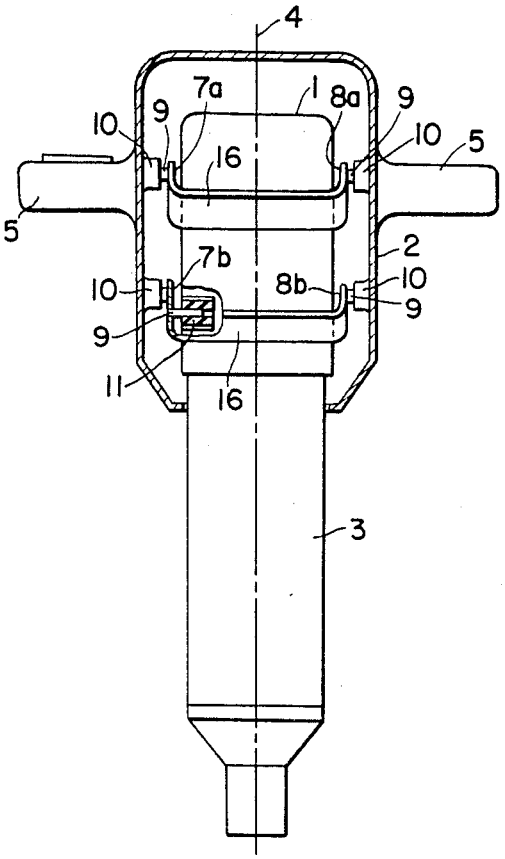
FIG. 1 shows a first embodiment of the inventive hammer from the rear, i.e. from the viewpoint of the operator, with the protective cover in section.
Figure 2:
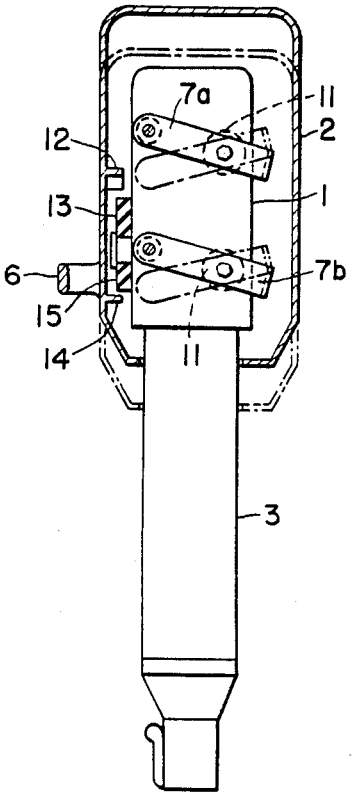
FIG. 2 is a side view of the embodiment of FIG. 1.
Figure 3:
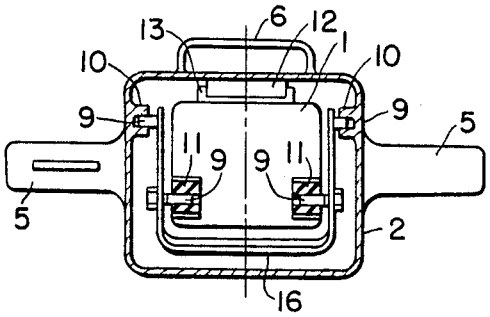
FIG. 3 is a plan view of the hammer of FIGS. 1 and 2, with the top of the protective cover being cut away.

Referring now to the drawings in detail, the hammer of FIGS. 1 to 3 is provided with a housing 1 that also includes the motor parts, on which other parts can be secured. The non-illustrated motor, which is arranged at the top, can be a gasoline engine or an electric motor, and in principle could also be a different type of energy source, such as a hydraulic or a pneumatic motor. In the illustrated embodiment, the top of the hammer housing 1 is enclosed on all sides by a protective cover 2 that extends at least around the motor region, but can also extend over at least a portion of the hammer shaft 3, in which is disposed the impact mechanism. The cover 2 is positively guided parallel to the longitudinal axis 4 of the hammer, and supports the customary handgrips 5 that are disposed on both sides. The cover 2 also supports the supplemental handgrip 6 that is required by the operator for reversing the unit and directing the hammer.

The parallel guidance between the hammer 1,3 and the protective cover 2 is effected by two pairs of swing arms *7a, 7b* and *8a, 8b,* with each of said pairs being disposed on a different side. The arms of a given pair are disposed parallel to one another and one above the other. One end of each of the arms is pivotably connected to the cover 2, and the other end is pivotably connected to the housing 1. To effect this pivotable mounting, each of the arms *7a, 7b, 8a* and *8b* is provided with a shaft stub 9; these shaft stubs extend from the arms at right angles to the respective cover or housing. In the embodiment illustrated in FIGS. 1–3, the shaft stubs 9 on the corresponding end of said arms merely extend into bores in bearing blocks 10 disposed on the protective cover 2. The shaft stubs 9 on the corresponding opposite end of the swing arms are rigidly connected with torsional sleeves 11 that are secured in the hammer housing 1; the periphery of these sleeves may be rigidly secured to the housing 1. The torsional sleeves 11 have a relatively great elasticity, so that they produce a soft shock absorption of the swing arms *7a, 7b, 8a,* and *8b* relative to the hammer housing 1, with the elasticity changing only slightly over a relatively large range of the reciprocal parallel displacement of the hammer housing 1 and the protective cover 2.

Figure 7:
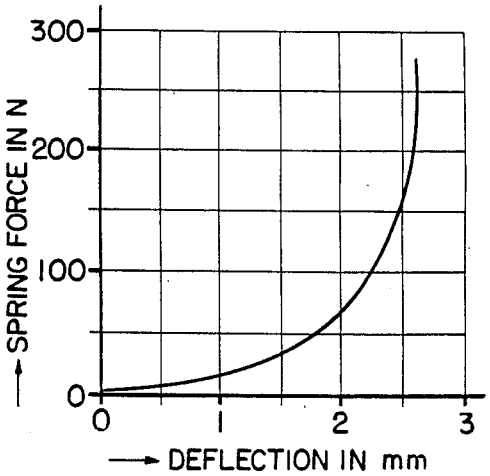
FIG. 7 is a spring characteristic curve, with the spring force being plotted against the deflection, and applies to elastic foamed polyurethane that is used as the material for elastic stops of the inventive hammer.

The aforementioned range of movement, with soft shock absorption between the hammer housing 1 and the protective cover 2, in other words the corresponding pivot range of the swing arms, is elastically delimited by stops 12, 13 and 14, 15 that are disposed between the cover 2 and the housing 1 and cooperate in a cushioned manner. The stops 12, 13 delimit movement in one direction, and the stops 14, 15 delimit movement in the opposite direction. The two pairs of cooperating stops 12,13 on the one hand and 14, 15 on the other hand, each comprise a rigid stop 12 or 14 that is disposed on the inside of the cover 2, and a cooperating stop 13 or 15 that is made of resilient material and is disposed on the hammer housing 1. The shape and material of these resilient stops 13 and 15 are such that there results for the cooperating stops 12, 13 and 14, 15 a progressive spring characteristic, such as the one illustrated by the curve in FIG. 7. An example of the material that is particularly suitable for providing such a spring characteristic is elastic, foamed polyurethane. Elastic polyurethane is also a particularly good material for the torsional sleeves 11, although in this case the polyurethane is not foamed. Both of the upper swing arms *7a, 8a,* as well as both of the lower swing arms *7b, 8b,* are respectively rigidly interconnected by connecting members 16 that form respective swivel brackets with the swing arms. Such a rigid interconnection of the swing arms is particularly suitable where the cover 2 does not have sufficient inherent rigidity to itself force a synchronous movement of the swing arms.

The protective cover 2 is high enough so that even when the greatest pressure or pulling is exerted upon the handgrips 5, the top of the cover 2 does not come into contact with the hammer housing 1.

To allow for differences in pulling and pressure, the cooperating stops 12, 13 on the one hand, and 14, 15 on the other hand, can be provided with different progressive spring characteristics. It is also advisable to make the cooperating stops adjustable (not illustrated) in order to be able to adapt the spring characteristic to varying applications of the hammer.

Figure 4:
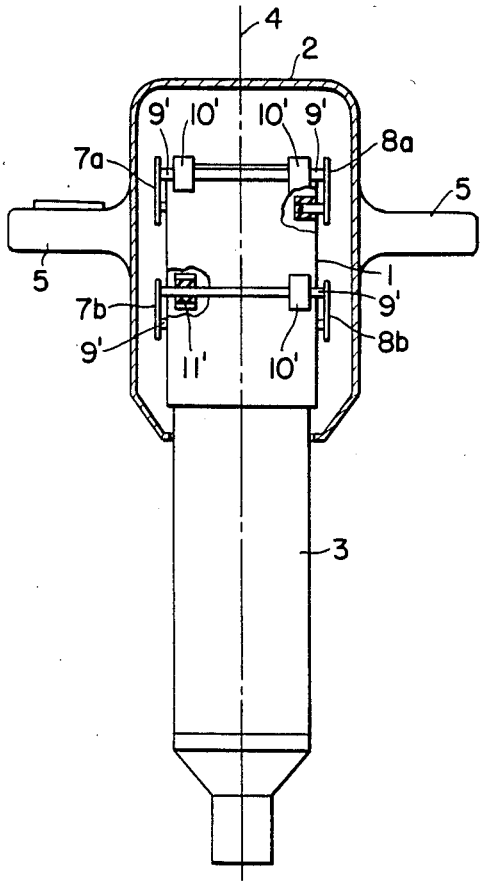
FIG. 4 shows a further embodiment of the inventive hammer, from the rear, with the protective cover again being in section.
Figure 5:
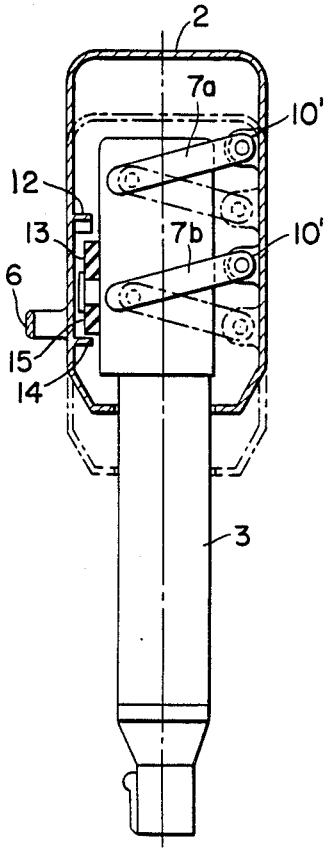
FIG. 5 is a side view of the hammer of FIG. 4.
Figure 6:
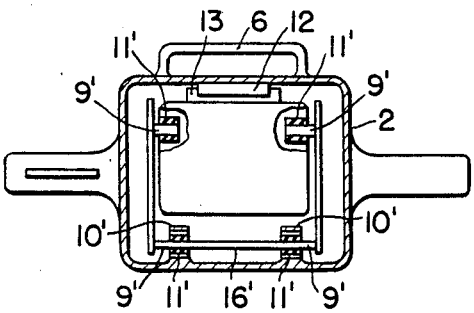
FIG. 6 is a plan view of the hammer of FIGS. 4 and 5, with the top of the protective cover being cut away.

The embodiment illustrated in FIGS. 4–6 coincides to a large extent to that illustrated in FIGS. 1–3. The difference is merely in the arrangement of the pivot and spring points for the swing arms *7a, 7b, 8a, 8b.*

In the embodiment of FIGS. 4–6, the shaft stubs 9' of both ends of the respective swing arms, as opposed to the shaft stubs 9 of only one end of the swing arms, engage torsional sleeves 11'. At one end, these torsional sleeves are disposed in the hammer housing, and at the other end the sleeves are disposed in bearing blocks 10' provided on that wall of the cover 2 that faces the operator. With regard to the shaft stubs 9' that are supported on the cover 2, both the upper and lower shaft stubs 9' are respectively interconnected to form continuous rods; these rods then effect the rigid interconnection between the swing arms *7a, 8a* on the one hand, and *7b, 8b* on the other hand. Although it is more expensive to divide the torsional elasticity among all eight shaft stubs or pivot points, an even more favorable spring characteristic results for the normal operating range.

The present invention is, of course, in no way restricted to the specific disclosure of the specification and drawings, but also encompasses any modifications within the scope of the appended claims.

What I claim is:

1. A motor-driven hammer having an impact mechanism that is driven by said motor via a crank drive; said hammer has a protective cover that is provided with handgrips and is cushioned relative to the housing of the hammer, which has a longitudinal axis; when viewed in the upright position of operation of said hammer, said protective cover is spaced from, and covers, the top, both sides, and the front of said motor and crank drive, at least relative to an operator; said hammer further comprises:

two pairs of swing arms that extend on both sides of said housing between the latter and said protective cover for positively guiding said cover parallel to said longitudinal axis of said hammer; the swing arms of a given pair of said swing arms are disposed parallel to one another, and are spaced apart one above the other; each of said swing arms has two ends, one of which is pivotably mounted on said cover, and the other of which is pivotably mounted on said housing, with said pivotable mounting being effected by pivot means, at least some of which are embodied in the form of soft torsion spring means; said swing arms have a pivot range that is free except for the soft torsion spring means effect; and stops for elastically delimiting said free pivot range of said swing arms; said stops cooperated resiliently in a cushioned manner, and are disposed on said housing of the hammer and said protective cover; said stops have a spring force with varying progressive spring characteristics that increases progressively from said free pivot range of said swing arms outwardly thereof.

2. A hammer according to claim 1, which includes respective connecting members for rigidly interconnecting respective ones of the swing arms of a pair of swing arms on one side of said housing with respective ones of the swing arms of the pair of swing arms on the other side of said housing.

3. A hammer according to claim 1, in which said pivot means include torsional sleeves supported by said housing, bearing blocks supported by said cover, and shaft stubs that are provided on said swing arms and engage respective ones of said torsional sleeves and said bearing blocks.

4. A hammer according to claim 1, in which said pivot means include torsional sleeves supported by said housing and said cover, and shaft stubs that are provided on said swing arms and engage respective ones of said torsional sleeves.

5. A hammer according to claim 1, in which said stops include rigid members disposed on said cover, and resilient members disposed on said housing, with each of said rigid members cooperating with one of said resilient members.

6. A hammer according to claim 5, in which at least some of said pivot means are torsional sleeves; and in which said resilient members of said stops, and said torsional sleeves, are made of elastic polyurethane.

7. A hammer according to claim 6, in which said elastic polyurethane of said resilient members is foamed.

8. A hammer according to claim 1, in which said protective cover also covers the front of said motor and crank drive on that side directed away from an operator.

* * * * *